US005400857A

United States Patent [19]

Whitby et al.

[11] Patent Number: 5,400,857

[45] Date of Patent: Mar. 28, 1995

[54] OILFIELD TUBULAR SHEAR RAM AND METHOD FOR BLOWOUT PREVENTION

[75] Inventors: Melvyn F. Whitby; David L. O'Donnell, both of Houston, Tex.

[73] Assignee: Varco Shaffer, Inc., Houston, Tex.

[21] Appl. No.: 163,432

[22] Filed: Dec. 8, 1993

[51] Int. Cl.[6] ..... E21B 29/08

[52] U.S. Cl. ..... 166/297; 166/55; 251/1.3; 285/922

[58] Field of Search ..... 166/297, 55; 251/1.3; 265/3, 114, 920, 922

[56] References Cited

U.S. PATENT DOCUMENTS

| | | | |
|---|---|---|---|
| 1,875,673 | 10/1929 | Stockstill . | |
| 1,949,672 | 3/1934 | Barrier . | |
| 3,561,526 | 5/1971 | Williams et al. . | |
| 3,590,920 | 7/1971 | Orund et al. . | |
| 3,736,982 | 6/1973 | Vujasinovic . | |
| 3,766,979 | 10/1973 | Petrick | 166/55 |
| 4,313,496 | 2/1982 | Childs et al. . | |
| 4,540,046 | 9/1985 | Granger et al. . | |
| 4,646,825 | 3/1987 | Van Winkle | 166/55 |
| 4,923,008 | 5/1990 | Wachowicz et al. . | |
| 4,987,956 | 1/1991 | Hansen et al. | 166/55 X |
| 5,025,708 | 6/1991 | Smith et al. . | |

*Primary Examiner*—William P. Neuder
*Attorney, Agent, or Firm*—Browning, Bushman, Anderson & Brookhart

[57] ABSTRACT

A ram assembly for positioning within a through bore of a blowout preventer body includes first and second opposing ram pistons each powering a respective knife blade. Each knife blade may have a pair of angled shear edges on opposite sides of the respective ram centerline, with each pair of angled shear edges defining a generally V-shaped configuration. The pair of opposing knife edges preferably engage the oilfield tubular at four contact points spaced substantially equidistant about a circumference of the tubular, and thereby contain the tubular for the shearing operation. According to the method of the present invention, the oilfield tubular is sheared substantially by brittle shearing rather than ductile shearing. By containing the tubular prior to shearing, the body of a shearing assembly may have a bore only slightly greater than the diameter of tubular to be sheared, thereby significantly reducing the costs and increasing the versatility of the shearing equipment, and also reducing the cost of the blowout preventer and the associated wellhead stack.

20 Claims, 2 Drawing Sheets

OILFIELD TUBULAR SHEAR RAM AND METHOD FOR BLOWOUT PREVENTION

FIELD OF THE INVENTION

The present invention relates to equipment and techniques for shearing an oilfield tubular which extends into a wellbore and, more particularly, relates to a ram-type blowout preventer and method for shearing the tubular.

BACKGROUND OF THE INVENTION

Blowout preventers for oilfield tubulars have been used for decades by operators of hydrocarbon recovery wells. U.S. Pat. Nos. 1,875,673, and 1,949,672 disclose early types of pressure control equipment for a well capping and extinguishing a fire at the surface of an oil or gas well.

Powered shear ram equipment has been commercially available since at least the early 1960's for shearing off an oilfield tubular, and for sealing against the tubular when the opposing rams are closed. U.S. Pat. No. 3,561,526 discloses the use of overlapping knife blades to perform the shearing function. U.S. Pat. No. 3,736,982 discloses a blowout preventer wherein the knife blade shearing rams are spaced above and are operable separately from the sealing rams of the blowout preventer. As shown in the '526 patent, the knife blades may be concave to include tubular engaging surfaces which taper slightly inwardly from the sides, so that the knife blades center the tubular as the rams move in. The tubular is sheared by first substantially flattening the pipe, and the subsequent shearing of the tubular thereafter occurs, as disclosed in this patent. Variations of this equipment include a single shear ram, as disclosed in U.S. Pat. No. 3,590,920.

A great deal of effort has been expended to enhance the utility and effectiveness of powered shear ram equipment for blowout preventers (BOPs). U.S. Pat. No. 4,313,496 provides a reciprocating device which is powered to cause the cutting blades to shear large diameter tubulars, such as casing and drill collars. This patent also discloses arms to resist the forces tending to vertically separate the cutting blades during the shearing operation. U.S. Pat. No. 4,540,046 discloses improvements in the shearing blade and ram block subassembly to reduce the thickness of the ram block, so that the opposing ram assemblies can seal off high pressure fluids. Other significant improvements have been made to enhance the reliability and operation of rams for the blowout preventer (BOP). U.S. Pat. No. 5,025,708 discloses an automatic lock for a ram actuator to prevent inadvertent opening of ram blocks, thereby increasing safety.

In spite of the improvements referenced above, hydrocarbon recovery operators have continued to desire equipment and techniques which more effectively and more reliably shear oilfield tubulars. U.S. Pat. No. 4,923,008 discloses a hydraulic power system specifically designed for providing the desired high pressure driving force to the ram pistons of a blowout preventer. This system initially provides sufficient power to substantially close the rams, after which time the system releases a high pressure force to cause the final shearing of the oilfield tubular.

One of the significant problems relating to shearing an oilfield tubular extending into a wellbore concerns the size of the blowout preventer body, which defines the through passageway for receiving a tubular of a maximum size. In a typical application, a blowout preventer body having an $18\frac{3}{4}$ inch bore is only able to effectively and reliably shear an oilfield tubular having less than a $10\frac{3}{4}$ inch diameter, since the flattening out of the tubular during the shearing process would otherwise cause the edges of the flattened tubular to be forced into binding engagement with the side walls of the BOP passageway, thereby adversely affecting the safety and reliability of the shearing and BOP sealing operation.

The conventional shearing of an oilfield tubular by a shearing ram assembly by first substantially flattening the tubular also creates problems for subsequent operations. Since the top of the lower tubular still within the wellbore has been flattened, it is difficult to thereafter pump a plugging material into the lower tubular to "kill" the well. Also, the flattened top of the lower tubular is difficult to retrieve by a conventional fishing operation, particularly since the flattened end corners are spaced apart a distance substantially greater than the tubular diameter, and tend to catch on the sidewalls of the BOP.

The disadvantages of the prior art are overcome by the present invention, and an improved blowout preventer and techniques for shearing a oilfield tubular extending into a wellbore are hereinafter provided. The present invention discloses a reliable technique for shearing an oilfield tubular, which can generally be accomplished with less power being supplied to the shearing rams compared to prior art shearing techniques. Moreover, the apparatus of the present invention is able to effectively shear a comparatively larger diameter oilfield tubular, so that a blowout preventer body having an $18\frac{3}{4}$ inch bore may effectively shear a tubular having a diameter of up to approximately $16\frac{3}{4}$ inches.

SUMMARY OF THE INVENTION

In an exemplary embodiment, the blowout preventer apparatus of the present invention includes an upper shear ram and a lower opposed sealing ram. Each upper ram blade is preferably symmetrical about a centerline passing through the respective ram piston, and has a pair of shear surfaces each angled at 45° with respect to the centerline of the respective piston. The shearing ram blades initially engage the tubular at four points spaced substantially equidistant about the circumference of the tubular, so as to effectively contain the tubular between the blades. As the ram blades thereafter move inwardly in response to increased hydraulic pressure, the circular tubular is deformed toward a generally rectangular configuration, rather than a flattened configuration. The further increase in the hydraulic pressure will shear the tubular in substantially a brittle shearing manner, so that the rectangular tubular "snaps" to separate, rather than being flattened and sheared in a ductile manner. By first containing rather than flattening the tubular, a BOP having a given bore diameter may be effectively used to reliably shear substantially larger tubulars than was possible with conventional shearing equipment, thereby increasing the versatility and reducing the cost of the equipment. Also, the substantial brittle shearing action which occurs according to the present invention utilizes less pressure or force than prior art ductile shearing techniques, so that the hydraulic power provided to the BOP rams may be less than the power required to operate prior art shearing equipment. Accordingly, less expensive accumulator banks or other power sources need be provided at the well site.

It is an object of the present invention to provide a blowout preventer with improved shearing blades which allow the equipment to shear a tubular having a diameter only slightly less than the diameter of the bore through the blowout preventer.

According to the technique of the present invention, opposing sealing rams may be activated to seal the annulus about an oilfield tubular. A substantially radially inward directed force may be transmitted to the tubular at four points above the sealing rams, with each of the four points being substantially equally spaced about the periphery of the tubular. The applied force substantially deforms the tubular toward a generally rectangular configuration. Alternatively, each blade may engage the tubular along an arcuate length of approximately 110°, thereby containing the tubular and preventing flattening. The continued application of high forces creates separation cracks through the sidewalls of the oilfield tubular due to brittle shearing, so that the contained tubular "snaps" during the application of an overall force which typically is significantly less than the force required for conventional shearing of an oilfield tubular. Once the tubular has been sheared according to the technique of the present invention, the upper portion of the tubular above the shear rams may be easily removed from the wellbore, while the lower portion of the tubular below the shear rams remains within the well. The annulus below the shearing ram assemblies may be sealed by sealing ram assemblies.

It is another object of the invention to improve the techniques for shearing a tubular extending into a wellbore so as to utilize less force than prior art shearing techniques. The present invention relies substantially on a brittle shearing concept, wherein the tubular is first contained and is then sheared.

It is a feature of the present invention that each of the shearing blades may be angled at approximately 45° with respect to a centerline of the respective ram piston so that the same ram assemblies may shear different diameter tubulars. For this embodiment, the pair of opposing blades each initially engage the tubular at four substantially equidistant circumferential spacings of approximately 90° to effectively contain then shear the tubular. Alternatively, the maximum diameter of a tubular which may be reliably sheared within a BOP of a certain bore size may be maximized by providing a pair of shearing blades each having an arcuate surface that engages the tubular over a circumferential length of at least 110°, thereby containing the tubular to prevent flattening, then shearing the tubular.

Another feature of this invention is that the stroke of the rams is relatively short between the engagement of the blades with the tubular and the final shearing, thereby minimizing equipment costs and the expenses associated with the bank of accumulators or other fluid supply to the BOP.

Yet another feature of this invention is that radially inward forces may be applied to an oilfield tubular at four points spaced substantially equidistant about the periphery of the tubular, so that the forces deform the tubular toward a generally rectangular configuration. Alternatively, the substantial arcuate length of the opposing blades in engagement with each tubular may contain the tubular while retaining substantially its original configuration. The continued application of forces creates separation cracks in the tubular walls, thereby effectively separating the tubular as a result of brittle shearing at the location of the applied forces.

A significant advantage of this invention is that a BOP with a certain bore diameter may reliably shear tubulars of varying diameters, including relatively small diameter tubulars and pipe having a diameter only slightly less than the diameter of the bore through the BOP.

By containing rather than flattening out the tubular prior to shearing, the diameter of the BOP through bore required for reliably shearing a specific diameter tubular may be significantly reduced compared to prior art equipment. A substantially cost savings is realized by not only reducing the size of the blowout preventer, but also reducing accordingly the size of the entire wellhead stack associated with the blowout preventer.

These and further objects, features, and advantages of the present invention will be apparent from the following detailed description, wherein reference is made to the figures in the accompanying drawings.

DETAILED DESCRIPTION OF PREFERRED EMBODIMENTS

Figure 1:
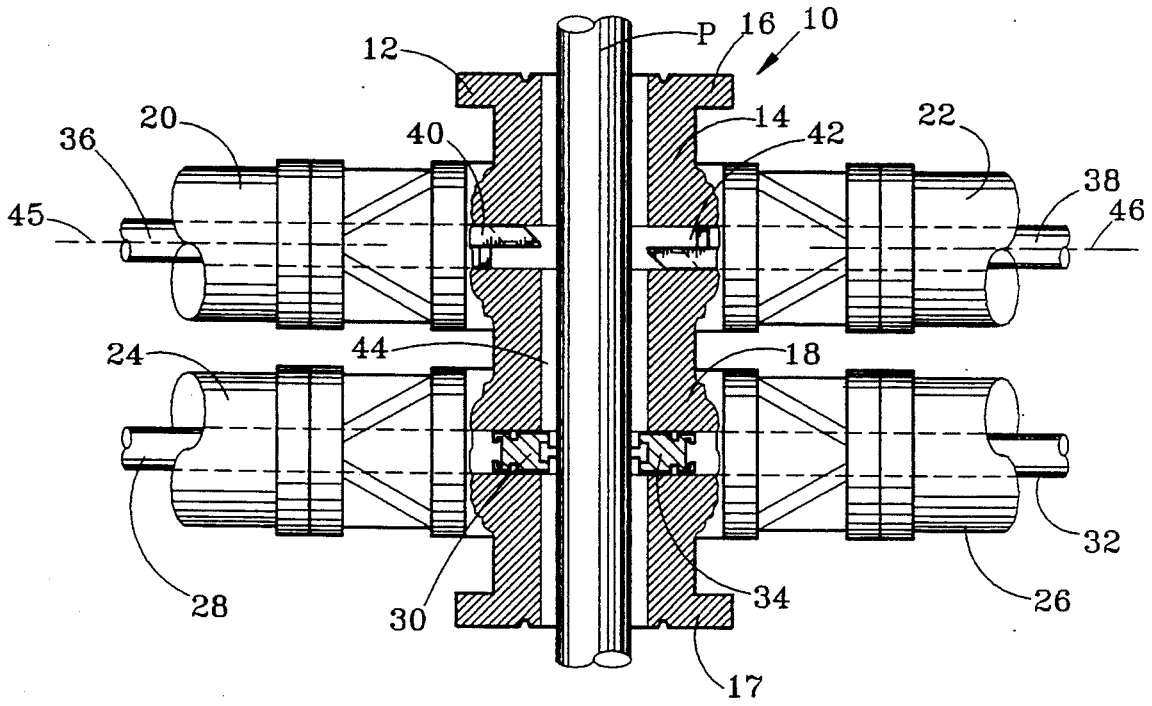
FIG. 1 is a simplified pictorial view, partially in cross-section, of a blowout preventer according to the present invention, with the sealing assemblies associated with each of the opposing lower rams being in sealed engagement with a pipe passing through the bore of the blowout preventer, and with the shearing blades associated with the upper opposing ram assemblies being retracted.

FIG. 1 depicts one embodiment of a shearing assembly 10 according to the present invention, which may comprise a blowout preventer body 12 having an upper portion 14 for receiving shearing ram subassemblies discussed subsequently, and a lower portion 18 for receiving sealing ram subassemblies also discussed subsequently. The body portions 14 and 18 may be formed separately or as an integral member, and preferably include an upper flange 16 and a lower flange 17 for sealed engagement with related wellhead equipment (not shown) conventionally mounted to the BOP body 12. Those skilled in the art will appreciate that the body 12 of the shearing assembly 10 includes a vertical through bore 44 having a generally cylindrical configuration, and that the oilfield tubular member or pipe P as shown in FIG. 1 passes through this bore in a conventional manner while the tubular is run in or pulled out of the wellbore. It should be pointed out that, for reasons explained subsequently, the body of the assembly 10 as shown in FIG. 1 having a certain diameter through bore is able to reliably shear a pipe P having a diameter substantially greater than the diameter of tubulars which may be reliably sheared by prior art shearing assemblies, thereby increasing the versatility of the assembly 10. As explained subsequently, the tubular P as shown in FIG. 1 may have a diameter in excess of 14 inches, with the through bore 44 having a diameter of less than 19 inches. This feature also substantially reduces the cost of the related wellhead equipment which is provided both above and below the assembly 10 for cooperation therewith for performing conventional oil recovery and work over operations. This feature thus significantly reduces the effective cost of both the shearing and sealing assembly 10 for receiving a large diameter oilfield tubular, and the cost of the related wellhead equipment.

A pair of upper shear ram subassemblies 20 and 22 are mounted to the upper body 12, with each shear ram subassembly including a respective piston 36 and 38 for moving respective shear blades 40 and 42 linearly from an open position to a closed position. Each ram subassembly 20 and 22 may be powered by a hydraulic fluid source (not shown) which simultaneously moves the shear blades 40 and 42 radially inward and outward. A suitable fluid power source for linearly moving the ram pistons 36 and 38 within the subassemblies 20 and 22 is disclosed in U.S. Pat. No. 4,923,008. Except for the configuration of the shearing blades, the ram subassemblies 20 and 22 may be of the type conventionally utilized in blowout preventers, and accordingly details regarding these ram assemblies are not discussed below.

The assembly 10 also includes opposing lower sealing ram subassemblies 24 and 26, which are similarly fluid powered and include ram pistons 28 and 32 each powering a respective sealing assembly 30 and 34. The pistons 28 and 32 and the sealing assemblies 30 and 34 are of the type which are conventionally used in blowout preventers, and further details regarding such equipment are disclosed in U.S. Pat. No. 3,590,920. Those skilled in the art will appreciate that the upper ram pistons 36 and 38 may be simultaneously activated for shearing the tubular P in an emergency, but that normally the shear blades 40 and 42 are retracted into the body of the BOP, as shown in FIG. 1. The lower sealing assemblies 24 and 26 may similarly be retracted into the body of BOP as the tubular is passed through the cylindrical bore 44, although the pistons 28 and 32 may be simultaneously activated at selected times to move the respective sealing assemblies 30 and 34 radially inward and into sealing engagement with the pipe P as shown in FIG. 1, so that the annulus between the pipe and the body 12 of the assembly is reliably sealed. In a typical application, the assembly as shown in FIG. 1 may be part of a subsea wellhead assembly, with the pipe P extending from a ship into a wellbore beneath the seabed. During a storm or other emergency, it may be necessary for the ship to be structurally released quickly from the wellhead, in which case the upper ram assemblies 20 and 22 may be activated for shearing the pipe P.

Figure 2:
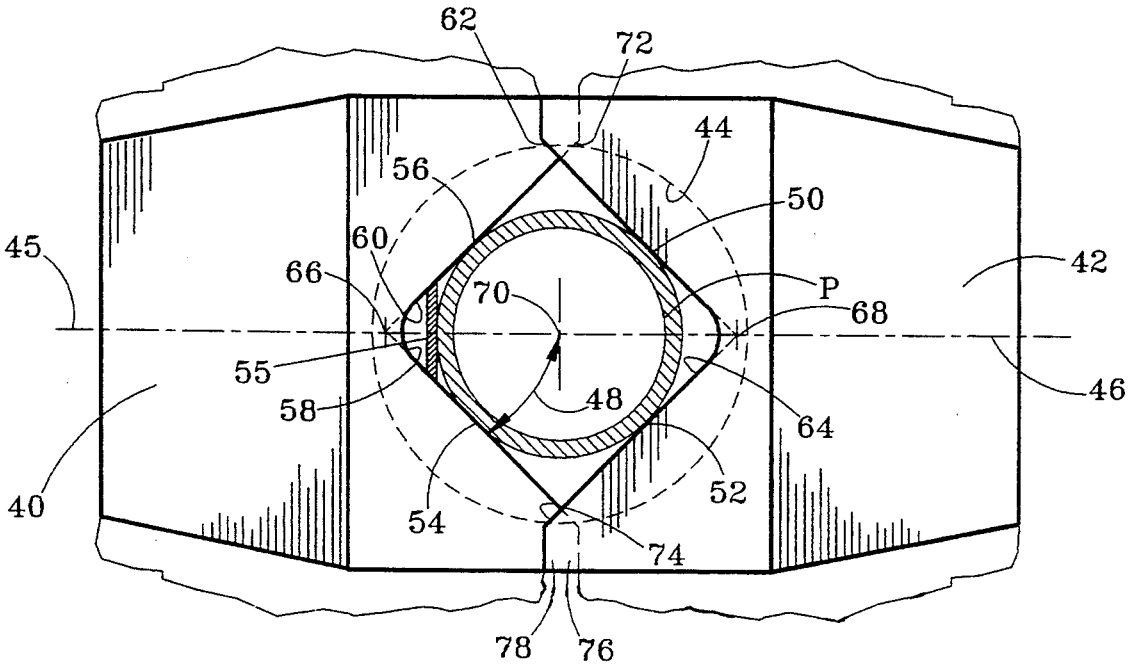
FIG. 2 is a simplified top view of the shearing blades, illustrating the general configuration of the blades according to the present invention, and illustrating the substantial equidistant four point contact of the blades with the pipe prior to shearing.

FIG. 2 depicts the shearing or knife blades 40 and 42 for the shearing ram assemblies 20 and 22, with each knife blade be positioned in contact with the pipe P prior to the application of any substantial radially directed forces being transmitted to the pipe through the blades. The knife blade 40 includes a pair of angled shear edges 58 and 60 on opposite sides of a piston centerline 45 for the ram assembly 20, while the knife blade 42 includes similar angled surfaces 62 and 64 on opposite sides of the respective ram piston centerline 46. Each pair of angled shear edges for each knife blade defines a generally V-shaped configuration having a respective knife blade apex 66 and 68, respectively. It should be understood that each knife blade apex may be a point on the V-shaped configuration of each knife blade, but more preferably is an imaginary point where the respective pair of angled shear edges intersect. When the subassemblies 20 and 22 are simultaneously activated to open or close, the apexes 66 and 68 of each knife blade 40 and 44 thus move linearly along a line substantially coaxial with the respective piston rod centerline 45 and 46.

According to the present invention, each of the shear edges 58 and 60 is a linear shear edge for line contact engagement with the tubular P. Each linear shear edge is preferably positioned at an angle, represented by angle 48 in FIG. 2, which is from 27° to 55° with respect to a ray extending from the apex 66 of the V-shaped configuration to the center 70 of the bore 44 through the blowout preventer. More particularly, each of the angled shear edges for the knife blade 40 is angled at from 40° to 50° with respect to the ram centerline 45, and most preferably is angled at approximately 45° with respect to centerline 45. With both blades 40 and 42 being configured with shear edges at this 45° angle, the blades cooperate to engage the oilfield tubular at four contact points 50, 52, 54, and 56 spaced substantially equidistant about the circumference of the oilfield tubular, e.g., the contact points are spaced approximately 90° apart. Each pair of angled shear edges for each of the knife blades is thus preferably symmetrical about the centerline of its respective ram piston, and the knife blades 40 and 42 themselves are preferably symmetrical with respect to plane perpendicular to the respective centerlines 45 and 46. By angling each of the shear edges at approximately 45 ° with respect to its respective ram piston centerline, it should be understood that, regardless of the diameter of the tubular, the opposing knife blades will engage the tubular P at four substantially equally spaced contact points to contain the tubular. FIG. 2 also depicts the position of the knife blades with respect to the cylindrical bore 44 when engaging the tubular. Each knife blade preferably includes portions 72, 74 on opposite sides of the respective ram piston centerline that are spaced apart a sufficient distance so that the knife blades as shown in FIG. 2 are capable of reliably containing and shearing a tubular. The tubular to be sheared may have a maximum diameter of about 90% of the diameter of the BOP bore.

Figure 3:
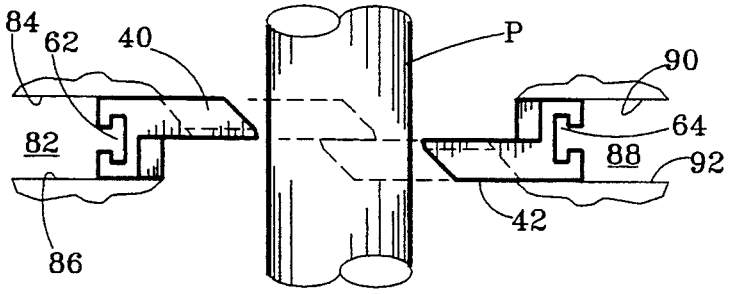
FIG. 3 is a side view of the opposing shearing blades generally shown in FIG. 1.

As shown in FIG. 2, blades 40 and 42 preferably overlap slightly when positioned so that the blades initially engage the pipe P. A portion 76 of blade 40 may thus be positioned above portion 78 of blade 42 when the blades first contact the pipe, so that the upper and lower surfaces of the cavities within the BOP which receive the knife blades and the overlapping knife blades themselves cooperate to achieve smooth radial inward movement of the knife blades and prevent axial separation of the cutting edges. FIG. 3 thus depicts the relative positions of the shear blades which, at their outer edges as shown in FIG. 2, overlap slightly when the shear edges first engage the pipe. The ram cavity 82 between the upper surface 84 and the lower surface 86 of the subassembly 20 is thus sized to receive a piston rod (not shown in FIG. 3), which engages the adaptor end 62 to interconnect the ram piston with the knife blade 40. The opposing cylindrical cavity 88 between surfaces 90 and 92 of subassembly 22 is similarly adapted to receive the piston rod for the ram assembly 22, with adaptor end 64 interconnecting the piston with the knife blade 42.

Figure 4:
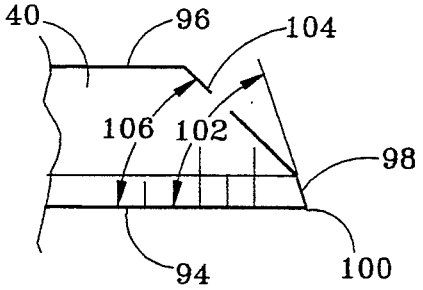
FIG. 4 is a detailed side view of the engaging edge of a shearing blade according to the present invention.

FIG. 4 depicts in greater detail a suitable cross-sectional configuration of the knife blade 40 generally shown in FIG. 1. It should be understood that the lowermost surface of the knife blade 40 as shown in FIG. 3 may slidably engage the surface 86. The lower planar surface 94 on the knife blade 40 as shown in FIG. 4 is perpendicular to the centerline 70 of the bore 44, and thus will be a generally horizontal surface when the pipe P is vertically positioned as shown in FIG. 1. The opposing upper surface 96 of the knife blade is a similar planar horizontal surface parallel with surface 94. The leading edge of the knife blade is provided with a terminal edge surface 98 which extends downward to intersect the surface 94 and form a knife line 100. The surface 98 is preferably positioned with respect to surface 94 at an angle of from 60° to 80°, and preferably at about 70°, with respect to surface 94, which angle is depicted at 102 in FIG. 4. The angle 102 for the terminal edge surface of each knife blade is substantially reduced compared to prior art blades, since the terminal edge surface does not shear in a ductile manner, but instead transmits the forces required for substantially brittle shearing, preferably through substantially line contact between the knife blade and the tubular. By providing a knife edge formed by intersecting surfaces 94 and 98, the knife edge is not susceptible to chipping or other damage when knife line 100 makes line contact engagement with the pipe P, and thereafter transmit high forces to the pipe to effect brittle shearing. Each knife blade preferably also includes a lifting surface 104 which intersects with the surface 98 and is spaced radially outward from the terminal edge surface 98, as shown in FIG. 4. The lifting surface 104 is preferably angled with respect to planar surface 94 at an angle of from 35° to 55°, and preferably at about 45°. This angle is depicted at 106 in FIG. 4. The lifting surface 104 assists in axially separating the pipe P once it is sheared, since radially inward movement of the knife blades will exert an axial separating force on the sheared pipe due to the opposing lifting surfaces. Although not depicted, it should be understood that the knife blade 42 may be constructed in the same manner as knife blade 40, so that the two knife blades reliably engage the pipe P as shown in FIG. 3 when the pistons 36 and 38 are simultaneously extended to shear the pipe P. Minimum damage occurs to the knife blades during shearing, due largely to the high angle of surface 98 and the comparatively low force required for substantially brittle shearing of the oilfield tubular, rather than substantially ductile shearing.

Figure 5:
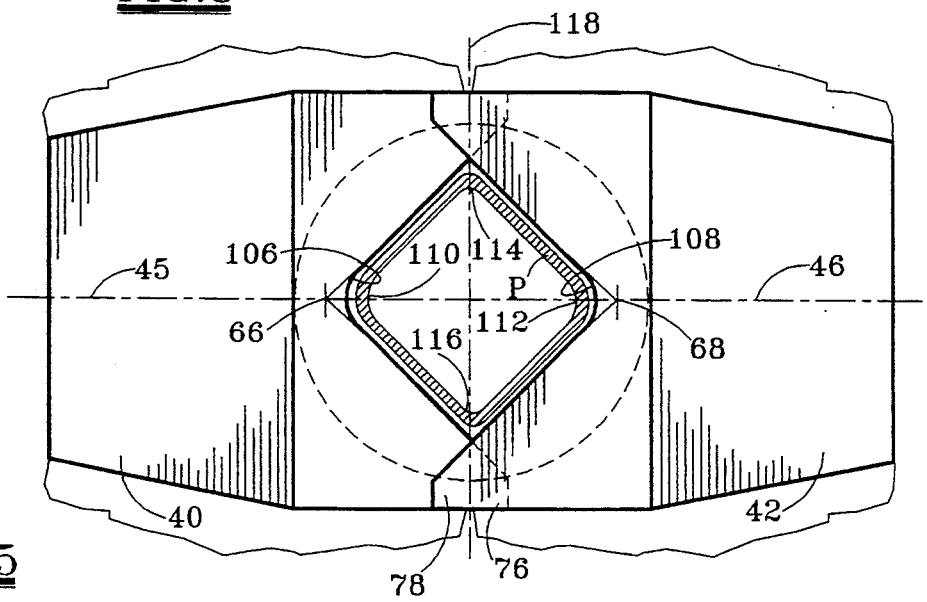
FIG. 5 illustrates the position of the shearing blades as shown in FIG. 2 subsequent to brittle shearing of the tubular, which was deformed by the shearing blades toward a generally rectangular configuration prior to shearing.

FIG. 5 depicts the position of the opposing shear blades 40 and 42 at the time when the pipe P has been sheared. The right hand portions 76 of the blade 40 thus overlap the left hand portions 78 of the blade 42 to a degree greater than shown in FIG. 3. The radially inward movement of the blades 40 and 42 has deformed the pipe P so that it has substantially a rectangular configuration prior to shearing. The shape of the rectangular configuration of the pipe P thus corresponds with the linear shear edges of the blades of a time of just prior to shearing. The rounded portions 106 and 108 of each shear blade spaced radially inward from the respective apexes 66 and 68 form the corresponding rounded edges 110 and 112 of the otherwise generally rectangular-shaped pipe. The other two corners 114 and 116 of the rectangular-shaped pipe are deformed by the intersecting edges of the opposing knife edges. Each of these corners 114 and 116 thus line substantially along a plane 118 which is perpendicular to the ram piston centerlines 45 and 46. Once the pipe P has been deformed to the substantially rectangular-shaped configuration, the further application of radially inward directed forces creates stress fractures in the pipe which propagate to essentially result in brittle shearing of the tubular, rather than ductile shearing. Since the tubular is contained prior to shearing to prevent the tubular from flattening out, the bore 44 of the BOP is not damaged by engagement with the tubular during the shearing action.

Once the tubular P has been sheared, each of the ram assemblies 20 and 22 may be retracted to the position as shown in FIG. 1. For smaller diameter tubulars within a casing, the upper sheared section of pipe P removed while the lower section of pipe P remains in sealed engagement with the sealing assemblies 30 and 34. The sealing assemblies 30 and 34 may, however, be positioned substantially below the sheering ram assemblies. If a larger diameter tubular such as a casing is sheared, the sheared lower section of casing will typically drop in the wellbore, and may be subsequently removed by a convention fishing operation.

An advantage of the present invention is that the lower section of pipe, as shown in FIG. 5, is not flattened, and accordingly the lower section of pipe may be easily stabbed with convention fishing equipment to retrieve the lower section of pipe, if desired, from the wellbore. Also, fluid may be easily pumped into the lower section of pipe through the substantially rectangular-shaped top configuration of the pipe, which operation is not easily accomplished if the pipe has been flattened in a manner convention with prior art equipment.

Figure 6:
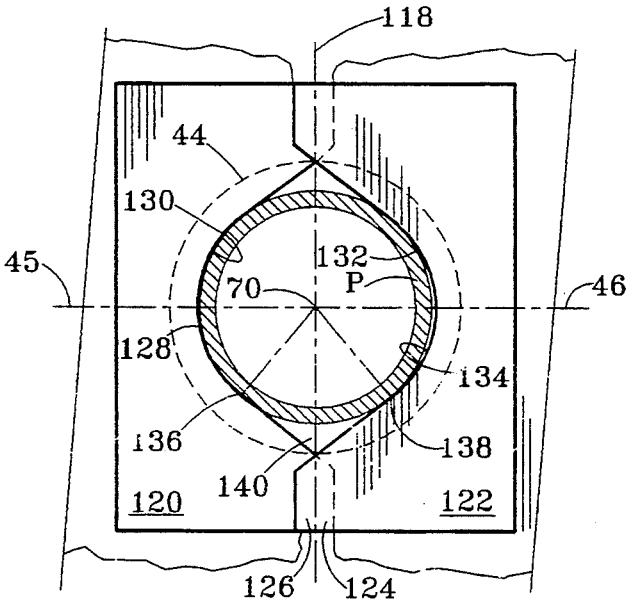
FIG. 6 illustrates an alternate embodiment of shearing blades according to the present invention in engagement with the pipe prior to shearing.

FIG. 6 depicts an alternate embodiment of the present invention, wherein the configuration of the knife blades as discussed above has been revised. The knife blade 120 as shown in FIG. 6 thus replaces the knife blade 40, and the knife blade 122 is similarly used instead of the knife blade 42. The same numerals are used for corresponding components. The knife blade 120 is thus moved radially inward and outward along centerline 45 of the left hand ram assembly, while the knife blade 122 similarly is moved linearly along the ram centerline 46. With respect to plane 118 which is perpendicular to centerlines 45 and 46, the outer edge portions 124 of the blade 122 thus slightly overlap the outer edge portions 126 of the blade 122 when the blades initially engage the pipe P. Rather than having a substantially V-shaped configuration, it may be seen that each of the knife blades 120 and 122 has an arcuate configuration, with the shear edges 128 and 130 of blade 120 on opposite sides of the ram piston centerline 45 cooperating to engage the oilfield tubular P along an arcuate distance of at least 110°, and preferably at least 120°, to contain the tubular and prevent the tubular from flattening prior to shearing. Similarly, shear edges 132 and 134 of the knife blade 122 are positioned on opposite sides of the ram piston centerline 46 cooperate to engage the oilfield tubular along an arcuate distance of at least 110°, and preferably at least 120°, so that the opposing shear blades together engage the tubular P along the circumferential distance of at least 220°, and preferably at least 240°, thereby effectively containing the tubular and preventing flattening of the tubular before shearing. The point 136 on the knife blade 120 is the point where the knife blade disengages the tubular P at the time of contact between the blade and the pipe, with the opposing point being 138 on the knife blade 122. The points 136 and 138 are arcuately spaced at the time of blade contact with the pipe a distance of approximately 70° or less, with this arcuate distance being minimized so that the tubular P does not tend to flatten out into the cavity 140 between the knife blades when the ram pistons are extended to a closed position.

According to the prior art, the opposing knife blades first engaged the tubular, then crushed or deformed the tubular to a substantially flattened configuration, then finally sheared the tubular. This action resulted in linear movement of each of the knife blades from the time of engaging the tubular to the final shearing which approximated the radius of the tubular. As can be seen by comparing FIGS. 2 and 4, each of the knife blades according to the present invention may move a substantially shorter distance between the point of engaging the tubular and the point of shearing the tubular, so that the driving power for the rams can be designed to accomplish shearing with less ram piston travel. It is also important that the actual pressure required for shearing according to the present invention is generally less than the pressure required to shear the tubular according to prior art techniques. Tests have indicated that shearing of a specific oilfield tubular by conventional shearing techniques will require approximately 50% more force being applied to the opposing shearing assemblies as compared to the present invention for reliable shearing of the same oilfield tubular.

As previously noted, a related significant advantage of this invention is that a BOP with the same size through bore containing the shearing blades of the present invention is able to reliably shear pipe having a significantly larger diameter than was possible with prior art shearing equipment. Stated differently, the size of the BOP through bore, and thus the size of the BOP itself, may be substantially reduced according to the present invention while still reliably shearing the same size tubular. Accordingly, it should be understood that each of the shearing ram assemblies of this invention may be designed for less travel between the fully retracted position and the position where the knife blades first engage the tubular, since for the same size BOP through bore, the shearing apparatus of the present invention may shear a larger diameter tubular.

The embodiment of the invention as shown in FIG. 6 is intended to benefit even further from the capability of the BOP to shear a tubular having a diameter only slightly less than the diameter of the bore through the BOP. As shown in FIG. 6, each of the blades need only travel radially inwardly a short distance from its retracted position to the position where the blades engage the pipe. Since shearing will occur with very little further radial movement of the shearing blades from the position as shown in FIG. 6, the overall linear travel of each of the ram pistons is further reduced. More importantly, however, the BOP with ram pistons powering blades as shown in FIG. 6 is able to receive, contain, and reliably shear a pipe having a diameter of only slightly less than the bore through the BOP. In a suitable application, the BOP bore 44 may have a diameter of approximately 18¾ inches, and the blades 120 and 122 as shown in FIG. 6 may reliably shear the pipe P having a diameter of approximately 16¾ inches. One disadvantage of a BOP with the blades as shown in FIG. 6 compared to a BOP with the blades as shown in FIG. 2 is that blades with the V-shaped configuration as shown in FIG. 2 may shear tubulars with substantially less shearing force than arcuate blades. Also, the arcuate blades can only effectively shear tubulars with a relatively low force if the curvature of the blade approximates the curvature of the tubular. The V-shaped blades as shown in FIG. 2, on the other hand, can effectively shear tubulars with a relatively low force even when the diameter of the tubulars appreciably changes.

To effectively contain the tubular P and prevent the tubular from flattening, yet thereafter be capable of transmitting sufficient forces to the tubular to result in substantially brittle shearing, each of the pair of shear edges on each knife blade may thus initially engage the tubular as essentially a point contact (as shown in FIG. 2) or a line contact (as shown in FIG. 6). These two points (or the approximate circumferential center point of at least a portion or line segment of the two lines) should engage the tubular a substantial circumferential distance apart, i.e., ideally about 90° as shown in FIG. 2 or about 90° as shown in FIG. 6. This circumferential distance or spacing for a knife blade could be somewhat increased, although generally with some disadvantages, and the circumferential spacing between opposing points (e.g., points 52 and 54 in FIG. 2) would then necessarily decrease. The circumferential spacing between two points on a knife blade (e.g., points 54 and 56 in FIG. 2) could be decreased, for example by making angle 48 larger than 45° to shorten the circumferential spacing between points 54 and 56.

For blowout prevention equipment, a significant disadvantage to increasing the circumferential spacing discussed above to more than 90° is the increased force required to cause shearing (particularly if there are only two contact points for a blade), since the same fluid pressure on the pistons will result in less axially directed force being transmitted to the tubular. If a central planar surface such as surface 55 in FIG. 2 were used between the surfaces 54 and 56 (each at 45° from axis 55), the tubular would be contained, although then the knife blade would be specialized for a particular size pipe so that all three surfaces would initially engage the pipe. It should be understood that this circumferential spacing between two points on the same knife blade, or between the two farthest points if three or more point contacts are used, should be at least 70°. If this circumferential spacing is reduced to less than 70°, the blades will not be able to reliably contain the tubular when hydraulic pressure is applied to move the blades radially inward. Also, the decrease of this circumferential spacing will require more fluid pressure on the opposing pistons to cause shearing compared to the first described embodiment.

According to the present invention, both shearing blades are preferably movable radially in response to fluid pressure from a retracted or open position to an extended or closed position. It may be possible, however, for one blade to be moved or positioned radially inward to act as a stop member, then the other blade powered to forcibly engage and shear the tubular as the tubular is forced against the stop member. The opposing shear blades are preferably similarly constructed to reliably contain the tubular and reduce equipment costs. The opposing blades could, however, be configured differently yet still achieve the primary goals of this invention.

According to the method of the invention, the shearing blades are configured as described above, and the blades used in a BOP assembly as generally shown in FIG. 1, which preferably includes lower sealing ram assemblies. To effect shearing, one blade or stop member may be moved radially inward prior to hydraulically powering the other blade. Preferably, however, hydraulic pressure is applied to simultaneously force both shearing blades inwardly into engagement with the tubular. After the tubular is contained, the continued application of hydraulic pressure to the opposing shearing rams creates stress features which result in substantially brittle shearing rather than ductile shearing of the tubular. The shearing action also axially separates the upper tubular section from the lower tubular section. Once the tubular has been sheared, the shearing blades may be retracted. Since the top end of the lower tubular section was not flattened prior to shearing, the lower tubular may be easily fished from the well. Alternatively, fluid may be pumped into the sheared lower tubular to kill the well.

Other configurations for the shearing blades will be suggested from the above description. As one example, the arcuate portions of the shearing blades adjacent the respective centerline 45 and 46 may be recessed, so that a gap exists between the circular portion of a shearing blade on one side of a ram centerline which engages the tubular and the corresponding circular portion on the opposite side of the ram piston centerline which engages the tubular. A particular advantage of the 45° angled shear edges as disclosed herein is that the knife blades will contact pipe of varying diameters of four approximately equally spaced points. The concepts of the present invention could be applied so that the linear shear edge was reduced to less than 45° or increased more than 45°, provided that the angles were controlled so that the tubular was contained before shearing. To obtain the benefits of the present invention, this shear edge angle on the low side should be at least 27°, and preferably will be at least 35°. On the high side, this shear edge angle should be less than approximately 55°, and preferably will be less than 50°.

Various additional modifications to the equipment and to the techniques described herein should be apparent from the above description of preferred embodiments. Although the invention has thus been described in detail for these embodiments, it should be understood that this explanation is for illustration, and that the invention is not limited to the described embodiments. Alternative equipment and operating techniques should be apparent to those skilled in the art in view of this disclosure. Modifications are thus contemplated and may be made without departing from the spirit of the invention, which is defined by the claims.

What is claimed is:

1. A ram assembly for positioning within a guideway within the body of a blowout preventer having a bore therethrough for receiving an oilfield tubular, the ram assembly comprising:

first and second opposing ram pistons each linearly movable along a respective ram piston centerline between an open position for passing the oilfield tubular through the bore of the blowout preventer, and a closed position for shearing the oilfield tubular within the bore of the blowout preventer;

first and second opposing knife blades carried by the respective first and second opposing ram pistons, each knife blade having a pair of angled shear edges on opposite sides of the respective ram piston centerline for engaging the oilfield tubular, each pair of angled shear edges defining a generally V-shaped configuration having a knife blade apex; and each angled shear edge being positioned at an angle of from 27° to 55° with respect to a ray extending from the apex of the V-shaped configuration to the center of the bore of the blowout preventer, such that the opposing knife blades contain then shear the oilfield tubular.

2. The ram assembly as defined in claim 1, wherein each of the angled shear edges are at an angle of from 40° to 50° with respect to the ray extending from the apex of the V-shaped configuration to the center of the bore of the blowout preventer.

3. The ram assembly as defined in claim 1, wherein each of the angled shear edges are at an angle of approximately 45° with respect to the ray extending from the apex of the V-shaped configuration to the bore of the center of the blowout preventer.

4. The ram assembly as defined in claim 1, wherein the first and second opposing knife blades cooperate to engage the oilfield tubular at four contact points spaced substantially equidistant about a circumference of the oilfield tubular.

5. The ram assembly as defined in claim 1, further comprising:

third and fourth opposing ram 5pistons each linearly movable along a respective lower ram piston centerline between an open position for axially passing the oilfield tubular through the bore of the blowout preventer and a closed position for sealing against the oilfield tubular within the bore of the blowout preventer.

6. The ram assembly as defined in claim 1, wherein each of the first and second knife blades is linearly movable such that the apex of the V-shaped configuration of each pair of angled shear surfaces travels along the line substantially coaxial with the respective ram piston centerline.

7. The ram assembly as defined in claim 1, wherein each of the shear edges is a substantially linear shear edge for line contact engagement with the oilfield tubular.

8. A shear ram assembly for positioning within a guideway within the body of a shear assembly having a bore therethrough receiving an oilfield tubular of a nominal diameter, the ram assembly comprising:

first and second opposing ram pistons each linearly movable along a ram piston centerline between an open position for passing the oilfield tubular through the bore of the shear assembly, and a closed position for shearing the oilfield tubular within the bore of the shear assembly; and first and second opposing knife blades each movably powered by a respective ram piston, each knife blade having a pair of shear edges on opposite sides of the ram piston centerline for engaging the oilfield tubular, the pair of shear edges being configured for engaging the oilfield tubular at a circumferential spacing of at least 70° to contain the oilfield tubular and prevent substantial flattening of the tubular prior the shearing.

9. The ram assembly as defined in claim 8, wherein the shear edges on opposite sides of the ram piston centerline are each angled to define a V-shaped configuration having a knife blade apex, each angled shear edge being positioned at an angle of from 40° to 50° with respect to a ray extending from the apex of the V-shaped configuration to the center of the bore of the shear assembly.

10. The ram assembly as defined in claim 9, wherein each of the angled shear edges are at an angle of approximately 45° with respect to the ray extending from the apex of the V-shaped configuration to the bore of the center of the blowout preventer.

11. The ram assembly as defined in claim 8, wherein the shear edges on opposite sides of the ram piston centerline engage the oilfield tubular along an arcuate length of at least 110° to contain the oilfield tubular.

12. The ram assembly as defined in claim 11, wherein the opposing stop member has an another pair of shear edges for engaging the oilfield tubular along an arcuate length of at least 110°.

13. The ram assembly as defined in claim 11, wherein each of the shear edges has a cross-sectional configuration defining a terminal edge surface angled from 60° to 80° with respect to a bore surface perpendicular to a centerline of the bore through the shear assembly body, and a lifting surface spaced radially outward from the terminal edge surface and angled at from 35° to 55° with respect to the bore surface.

14. A method of shearing an oilfield tubular while within the body of a shear assembly having a bore therethrough, the method comprising:

positioning a pair of knife blades on opposing sides of the tubular, each knife blade being configured for containing the oilfield tubular and preventing the tubular from flattening prior to shearing;

moving each of the knife blades radially into engagement with the oilfield tubular to force the oilfield tubular; and thereafter continuing to move at least one of the knife blades radially inward to shear the oilfield tubular.

15. The method as defined in claim 14, wherein each knife blade is configured to have a pair of angled shear edges defining a generally V-shaped configuration, each shear edge being angled at from 27° to 55° with respect to a ray extending from the apex of the V-shaped configuration to the center of the bore of the shear assembly.

16. The method as defined in claim 14, wherein the shear edge of each knife blade is angled at about 45° with respect to a ray extending from the apex of the V-shaped configuration to the center of the bore of the shear assembly.

17. The method as defined in claim 14, further comprising:

forming the knife blades to engage the oilfield tubular at four contact points spaced substantially equidistant about a circumference of the oilfield tubular.

18. The method as defined in claim 14, wherein the step of moving the knife blades radially into engagement with the oilfield tubular comprises:

supporting each knife blade at a radially inward end of a ram piston; and moving the ram piston to a closed position to move the respective knife blade radially inward.

19. A shear ram assembly knife blade for shearing an oilfield tubular positioned within the body of a blowout preventer when the oilfield tubular is engaged by another knife blade, the knife blade comprising:

a knife body having a pair of shear edges for engaging the oilfield tubular at a circumferential spacing of at least 70° to contain the oilfield tubular and prevent substantial flattening of the tubular prior to shearing.

20. The shear ram assembly knife blade as defined in claim 19, wherein the pair of shear edges defines a V-shaped configuration having an inclusive angle of from 54° to 110°.

* * * * *